US008348626B2

(12) United States Patent
Roy

(10) Patent No.: US 8,348,626 B2
(45) Date of Patent: Jan. 8, 2013

(54) METHOD AND APPARATUS FOR EFFICIENT MICROPUMPING

(75) Inventor: Subrata Roy, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 241 days.

(21) Appl. No.: 12/669,069

(22) PCT Filed: Jul. 25, 2008

(86) PCT No.: PCT/US2008/071262
§ 371 (c)(1),
(2), (4) Date: Jan. 14, 2010

(87) PCT Pub. No.: WO2009/015371
PCT Pub. Date: Jan. 29, 2009

(65) Prior Publication Data

US 2010/0200091 A1 Aug. 12, 2010

Related U.S. Application Data

(60) Provisional application No. 60/951,839, filed on Jul. 25, 2007.

(51) Int. Cl.
*F04B 37/02* (2006.01)
*F04F 99/00* (2009.01)

(52) U.S. Cl. ..... 417/48; 417/50

(58) Field of Classification Search ..... 417/48, 417/50; 60/202, 203.1
See application file for complete search history.

(56) References Cited

U.S. PATENT DOCUMENTS 3,095,163 A * 6/1963 Hill ..... 244/12.1
5,632,876 A * 5/1997 Zanzucchi et al. ..... 204/600
5,893,968 A 4/1999 Kato
5,938,854 A * 8/1999 Roth ..... 134/1
5,985,118 A 11/1999 Makino et al.
6,533,554 B1 3/2003 Vargo et al.
6,822,180 B2 11/2004 Fujii et al.
6,895,800 B2 5/2005 Tomura et al.
(Continued)

FOREIGN PATENT DOCUMENTS

JP 2006-187770 7/2006
(Continued)

OTHER PUBLICATIONS

Applicant's Admitted Prior Art: J. Reece Roth, Aerodynamic flow acceleration using paraelectric and peristaltic electrohydrodynamic effects of a One Atmosphere Uniform Glow Discharge Plasma, 2003, American Institute of Physics.*
(Continued)

*Primary Examiner* — Devon Kramer
*Assistant Examiner* — Christopher Maxey
(74) *Attorney, Agent, or Firm* — Saliwanchik, Lloyd & Eisenschenk

(57) ABSTRACT

Efficient micro-pumping of gas/liquids is provided. In one embodiment a pipeline of insulative material can be asymmetrically coated with electrodes. The asymmetric coating can affect the flow passage to create straight and swirl pumping effects. The electrodes can include electrode pairs arranged at intervals along the pipeline, each electrode pair being capable of inducing an electrohydrodynamic body force. The electrode pairs can be formed at the same surface, such as along the inner perimeter of the pipeline, and can be powered by steady, pulsed direct, or alternating current. Alternatively, the electrode pairs can be separated by the insulative material of the pipeline, and can be powered with direct or alternating current operating at radio frequency.

25 Claims, 4 Drawing Sheets

(a) Direct current (h=0) (b) Pulsed dc (h=0) (c) Barrier discharge

U.S. PATENT DOCUMENTS

| | | | | |
|---|---|---|---|---|
| 6,949,176 | B2 | 9/2005 | Vacca et al. | |
| 7,182,846 | B2 | 2/2007 | Mizutani et al. | |
| 7,637,455 | B2 * | 12/2009 | Silkey et al. | 244/53 B |
| 7,870,719 | B2 * | 1/2011 | Lee et al. | 60/202 |
| 7,887,301 | B2 * | 2/2011 | Zoulkarneev et al. | 417/48 |
| 7,988,101 | B2 * | 8/2011 | Osborne et al. | 244/205 |
| 2005/0009101 | A1 * | 1/2005 | Blackburn | 435/7.1 |
| 2008/0023589 | A1 * | 1/2008 | Miles et al. | 244/205 |
| 2008/0118370 | A1 * | 5/2008 | Zoulkarneev et al. | 417/50 |
| 2008/0131293 | A1 * | 6/2008 | Hanaoka et al. | 417/49 |
| 2010/0102174 | A1 * | 4/2010 | Roy | 244/23 C |
| 2010/0127624 | A1 * | 5/2010 | Roy | 315/111.21 |
| 2010/0150738 | A1 * | 6/2010 | Gimsa et al. | 417/48 |

FOREIGN PATENT DOCUMENTS

KR 10-2005-0097313 5/2006

OTHER PUBLICATIONS

Asuncion V. Lemoff, Lee, A. P., An AC magnetohydrodynamic micropump, 2000, Sensors and Actuators.*

Axel Richter, Sandmaier, H., An electrohydrodynamic micropump, 1990, IEEE.*

Roth, J.R., "Aerodynamic Flow Acceleration Using Paraelectric and Peristaltic Electro-hydrodynamic Effects of a One Atmosphere Uniform Glow Discharge Plasma", *Physics of Plasmas*, 2003, pp. 2117-2126, vol. 10, No. 5.

Roy, S., "Flow Actuation Using Radio Frequency in Partially-ionized Collisional Plasmas", *Applied Physics Letters*, 2005, pp. 101502-1 to 101502-3, vol. 86, No. 10.

Roy, S., et al., "Force Interaction of High Pressure Glow Discharge with Fluid Flow for Active Separation Control", *Physics of Plasmas*, 2006, pp. 023503-1 to 023503-11, vol. 13, No. 2.

Singh, K.P., et al., "Simulation of an Asymmetric single Dielectric Barrier Plasma Actuator", *Journal of Applied Physics*, 2005, 083303-1 to 083307-7, vol. 98, No. 8.

Roy, S., et. al., "Effective Discharge Dynamics for Plasma Actuators", AIAA 44$^{th}$ Aerospace Sciences Meeting and Exhibit, Jan. 9-12, 2006, AIAA-2006-0374 Paper, pp. 1-12, Reno, NV.

Visbal, M.R, et al., "Control of Transitional and Turbulent Flows Using Plasma-Based Actuators", AIAA Fluid Dynamics and Flow Control Conference, Jun. 2006, AIAA-2006-3230 Paper, pp. 1-22, San Francisco, CA.

* cited by examiner (a) Direct current (h=0) (b) Pulsed dc (h=0) (c) Barrier discharge

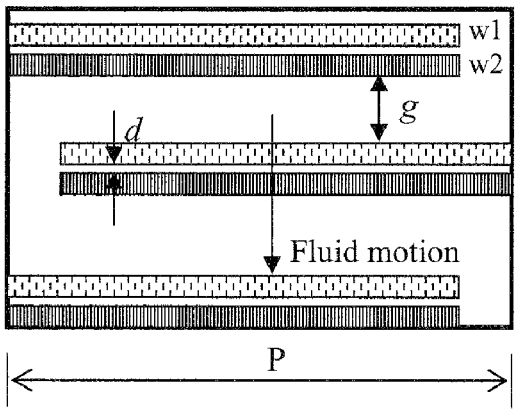
(a) Straight pumping
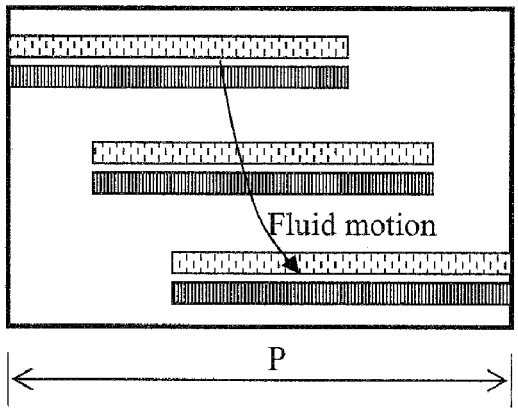
(b) Swirl pumping
FIG. 4A
FIG. 4B

METHOD AND APPARATUS FOR EFFICIENT MICROPUMPING

CROSS-REFERENCE TO RELATED APPLICATIONS

The present application is the U.S. National Stage Application of International Patent Application No. PCT/US2008/071262, filed on Jul. 25, 2008, which claims the benefit of U.S. Provisional Application Ser. No. 60/951,839, filed Jul. 25, 2007, both of which are hereby incorporated by reference herein in their entirety, including any figures, tables, or drawings.

BACKGROUND OF INVENTION

Microfluidic systems have been configured in various ways to move fluids through small channels. One configuration for channels where capillary forces dominate involves establishing a pressure differential between a point where the fluid is and a point where the fluid is to be moved. Other fluid pumps that address this problem of fluid flow utilize electrical, electrokinetic, or thermal forces to move fluids through microchannels. In instances where electrical driving forces are used, fluids may be moved through electrocapillary or electrowetting. In instances where electrokinetic forces are used, fluids may be moved through electrophoresis or electroosmosis. In addition, driving forces such as dielectrophoresis, electrohydrodynamic pumping, or magneto-hydrodynamic pumping are implemented by configuring electrodes and selecting and placing fluids within the microchannel in an appropriate manner.

For example, U.S. Pat. No. 5,632,876 utilizes electroosmosis and electrohydrodynamic principles, where wire electrodes are inserted into the walls of the channels at preselected intervals. As another example of fluid flow techniques, U.S. Pat. No. 6,949,176 uses capacitance forces to move fluid through a microchannel. In addition, the Knudsen pump, as described in U.S. Pat. No. 6,533,554 utilizes thermal transpiration for effecting gas flow.

However, there is a need for a fluid pump capable of efficient pumping of fluids, including gasses and liquids, which can have applications in small systems where capillary forces are not sufficient to create flow and Knudsen pumps are not workable.

BRIEF SUMMARY

Embodiments of the present invention provide efficient micro-pumping for small devices. In an embodiment a pipeline can be formed, asymmetrically coated with electrode patches. A small plasma can be generated in the vicinity of an exposed (powered) electrode to induce an electrohydrodynamic (EHD) body force, which can push a gas/liquid in particular direction. The electrodes can be arranged in the pipeline as electrode pairs. One embodiment can incorporate electrode pairs on the same surface and maintained at a potential bias using steady, pulsed direct, or alternating current. Another embodiment can incorporate electrode pairs separated by an insulative material where one electrode of the pair is powered with dc or ac operating at a radio frequency with respect to the other.

Pumping can be accomplished for electrically non-conductive fluids and for electrically conductive fluids. Embodiments used for pumping electrically non-conductive fluids can incorporate electrodes coated with a material having insulating properties, such as a dielectric, or can incorporate exposed electrodes. Embodiments used for pumping electrically conductive fluids can incorporate electrodes coated with a material having insulating properties, such as a dielectric material.

The arrangement of the electrodes in the pipeline can create, for example, straight or swirl pumping effects, or other desired pumping affects, by positioning the electrode pairs so as to provide forces in a manner to produce the desired pumping effect.

Micro-pumps in accordance with the invention can be used for pumping a variety of fluids, such as blood. The use of the subject micro-pumps can reduce, or substantially eliminate, shear forces on the surface of the micro-pump, resulting in a smooth flow. The reduction of shear for an embodiment of the subject micro-pump for pumping blood can reduce, or substantially eliminate breakage of blood particles during pumping due to shear forces with respect to the surface of the micro-pump in contact with the blood particles.

BRIEF DESCRIPTION OF DRAWINGS

FIGS. 4A and 4B illustrate different positioning of electrodes along the inner perimeter P of the flow passage for creating straight and swirl pumping effects, according to embodiments of the subject invention, where the inner surface of the flow passage has been laid out flat for illustration purposes.

DETAILED DISCLOSURE

Embodiments of the present invention can provide efficient pumping of fluids, including liquids and gases, in small systems and devices. Pumping can be accomplished using electromagnetic principles including electrohydrodynamic (EHD) forces.

An EHD force can be used to pump fluid in a small conduit without any mechanical components. A micropump according to various embodiments of the present invention can be very useful for biomedical and chemical applications. For example, in one embodiment, the micropump can be used in place of conventional mechanical heart pumps, which have been found to create shear breakage of blood corpuscles. In another embodiment, the micropump can be used in patients with heart blockage. In addition, embodiments of the present invention can be used in aerospace and other applications. For example, embodiments incorporating surface electrical discharge at atmospheric pressure can be used for boundary layer flow actuation. The actuators of the micropump according to some embodiments of the present invention can operate using (pulsed) dc and ac power supply and can apply large electrohydrodynamic (EHD) forces in a relatively precise and self-limiting manner. Further embodiments can have rapid switch-on/off capabilities. Specific embodiments can operate without any moving parts. Embodiments of the invention have application in small systems where capillary forces are not sufficient to create flow and/or in situations where Knudsen pumps are not workable.

Figure 1:
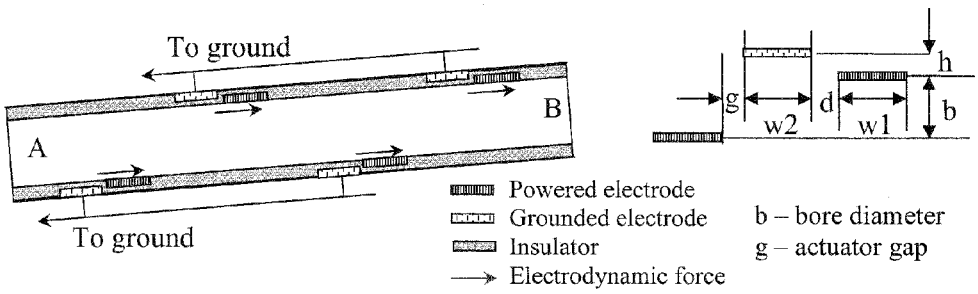
FIG. 1 shows a schematic of a micropump design according to an embodiment of the subject invention.
Figure 5A:
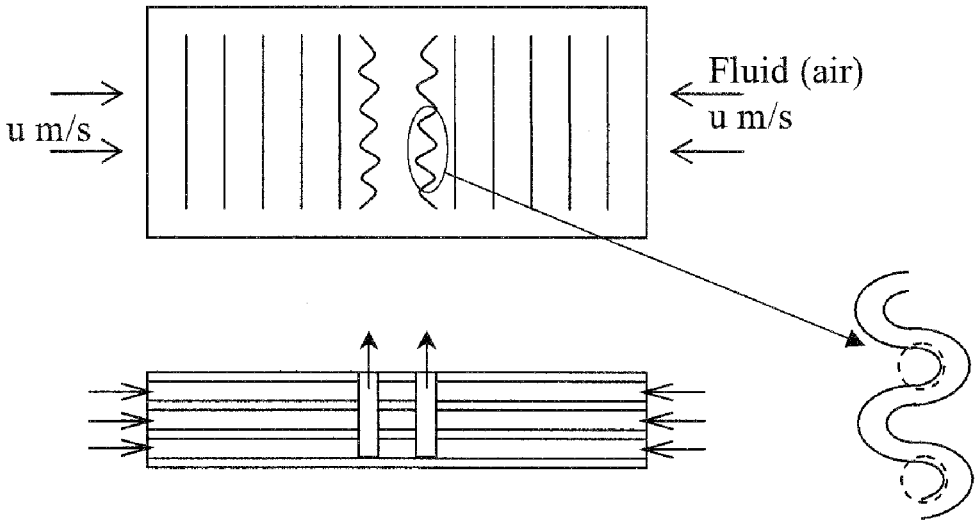
FIGS. 5A and 5B show embodiments incorporating parallel plate flow conduits.
Figure 5B:
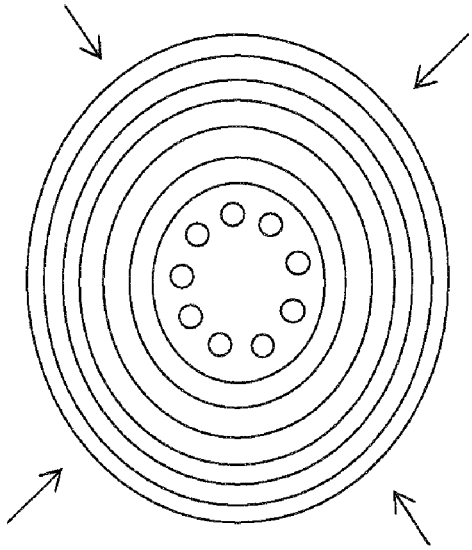

A variety of flow conduits and/or pipeline cross-sections can be implemented. Examples of cross-sections include, but are not limited to, circular, square, rectangular, polygonal, hexagonal, or parallel plates or curves. FIG. 1 can represent a cross-section through a flow conduit and/or pipeline having a circular, rectangular, or other shape cross-section, or a parallel plate configuration. FIGS. 4A and 4B can represent a laid open flow conduit and/or pipeline having a circular, rectangular, or other shaped cross-section, or a plate of a parallel plate configuration. FIGS. 5A and 5B show embodiments incorporating parallel plate flow conduits. The top portion of FIG. 5A shows a top of one of the plates of a parallel plate flow passage device. Each line shown represents an electrode pair, such as the electrode pairs shown in FIG. 2, with the blown-up drawing section showing a curved electrode pair that can act to direct the flow of the fluid away from the surface. The fluid located in the dotted region of the blown-up drawing section experiences forces from the electrode pair converging from the curved structure of the electrode pairs such that when the fluid is pushed away from the curved electrode pair, the fluid is pushed away from the surface of the plate. The dotted region of the blown-up drawing section can also have an aperture through the plate such that when fluid is pushed up from the plate below, the fluid travels through the plate and is continued to be pushed up. The bottom portion of FIG. 5A shows a side view of a stack of parallel plates having apertures through the top three plates such that fluid flows from the right and left, due to the force from multiple electrode pairs and is directed up as shown by the arrows exiting the apertures in the top plate.

The plates in the stack of plates in FIG. 5A can have a variety of shapes, such as square, rectangular, oval, circular, hexagonal, or polygonal. FIG. 5B shows a specific embodiment, which can be used as, for example, an air filter, having oval shaped plates. FIG. 5B shows multiple apertures through one of the plates, which can optionally coincide with apertures in other plates. Various configurations of apertures in the plates can be implemented. FIG. 5B also shows concentric electrode pairs that create forces on the fluid, for example, to push the fluid toward the center of the device. When used as an air filter, air is pulled in along the outer edges of the oval plates, pushed toward the center, and then directed up through the apertures. In a specific embodiment, when used as an air filter, the electrode pairs can also be used to extract the dust or other impurities from the air. The device of FIG. 5B can also be used as an air pump, pulling in air from the outer edges of the plates and exhausting the air out of the plurality of apertures. Such a fan can have quite a low noise. Such a device can be used as a heating, ventilation, and air conditioning (HVAC) pump, for example, in automobile applications. In a specific embodiment, the spacing between the plates shown in FIGS. 5A and 5B can be such that electrode pairs located on the surface of one or both plates creating the parallel plate flow orifices can create a bulk flow effect to move the fluid through the parallel plate flow orifice.

FIG. 1 shows a longitudinal cross-section of a pipeline according to an embodiment of the present invention. In one embodiment, the pipeline material can be an insulator and can have a bore diameter b. The pumping of gas/liquids through the pipeline may be accomplished utilizing electromagnetic effects such as an electrohydrodynamic body force and/or a magnetohydrodynamic effect through a Lorentz force. The forces can be induced using dynamic barrier discharge (DBD) electrodes. As illustrated in FIG. 1, the pipeline can be asymmetrically coated with electrode pairs. An electrode pair including a powered electrode having a width w1 and a grounded electrode having a width w2 can be formed adjacent each other and separated by a distance d. The electrode pair can be a DBD electrode pair, where the grounded electrode and the powered electrode can be separated a distance h by the insulator wall of the pipeline, or portion thereof. These electrode pairs can be formed at intervals along the pipeline. For example, the electrode pairs can be asymmetrically formed along the pipeline at intervals with an actuator gap g.

In an embodiment, the powered electrodes can be exposed along the inner perimeter of the pipeline. In another embodiment, the powered electrodes can have a coating separating the powered electrode from the fluid. Various embodiments can be applied to any fluids that can be ionized, such as air, gases, and liquids. For electrically non-conductive fluids, the electrode of the electrode pair near the surface can be exposed to the fluid, but a cover can be positioned over the electrode if desired. For electrically conductive fluids, a cover, such as dielectric coating, can be placed over the electrode near the surface. This cover can improve safety.

In operation, a small plasma can be generated in the vicinity of the exposed (powered) electrode to induce an amount of electrohydrodynamic (EHD) body force to push gas/liquid in a certain direction. A magnetic field can also be used to induce additional magnetohydrodynamic (MHD) effect through Lorentz force. In a specific embodiment, the magnetic field can be oriented such that the current flow of the gas and/or liquid crossed with the direction of the magnetic field creates a force away from the surface of the pipeline, so as to pinch the gas and/or liquid along. The net result can be very efficient pumping of fluid from point A to point B in a system.

Figure 2:
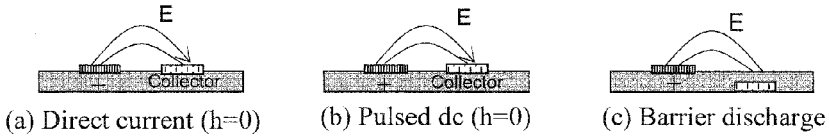
FIGS. 2A-2C illustrate different arrangements of the electrodes for a micropump according to embodiments of the subject invention.

The electrode pairs can be powered and formed in various configurations. FIG. 2 shows examples of electrode arrangements that can be incorporated in embodiments of the present invention. FIGS. 2A and 2B show an electrode pair with both electrodes on the same surface, where h=0. FIG. 2A illustrates the electrode pair as being maintained at a potential bias using steady direct current, and FIG. 2B illustrates the electrode pair as being maintained at a potential bias using pulsed direct current. In an another embodiment, alternating current can be used. FIG. 2C shows an electrode pair separated by an insulator layer. The electrode pair of FIG. 2C can also be referred to as barrier discharge electrodes where one electrode can be powered with dc or ac operating at a radio frequency. The powered electrode can be exposed to the gas, but embodiments can be provided where the powered electrode is not exposed to the gas.

In operation, electric forces can be generated between the electrodes. As the applied voltage becomes sufficiently large for a given interelectrode distance d and pressure p, the dielectric surface adjacent to the electrode can produce a surface discharge weakly ionizing the surrounding gas. In a specific embodiment, 1-20 kV peak-to-peak applied voltage with 2-50 kHz rf can be suitable for these actuators operating at atmospheric pressure. The plasma at this pressure is highly collisional, and can cause an efficient energy exchange between charged and neutral species. In this discharge, microfilaments of nanosecond duration with many current pulses in a half cycle can maintain the optical glow. Due to a combination of electrodynamic and collisional processes, charge separated particles induce the gas particles to move.

Figure 3A:
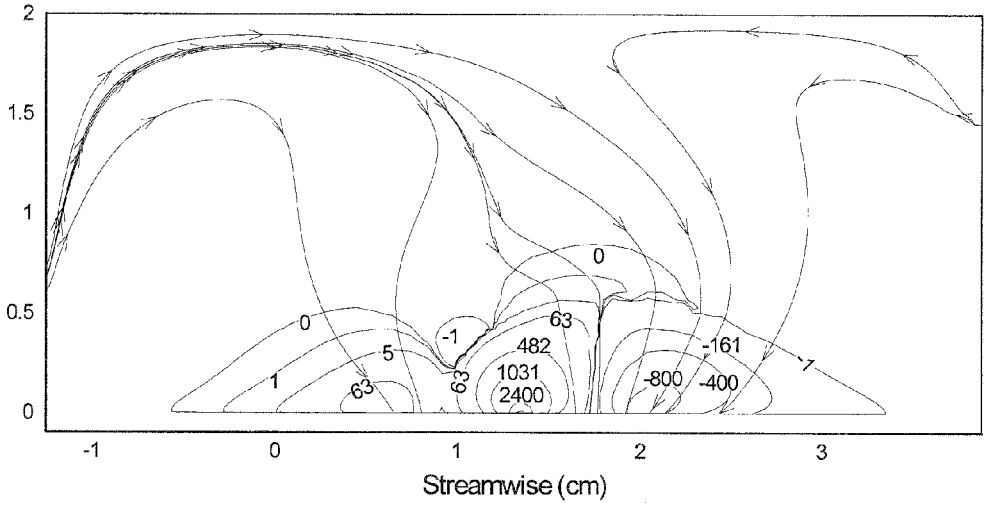
FIGS. 3A and 3B show EHD force prediction and the induced gas velocity due to this force, accordingly, where the exposed electrode is positioned between 0 and about 1.2 and the ground electrode is positioned from about 1.25 and about 2.5, on the streamwise axis, such that there is a space between the exposed electrode and the ground electrode.
Figure 3B:
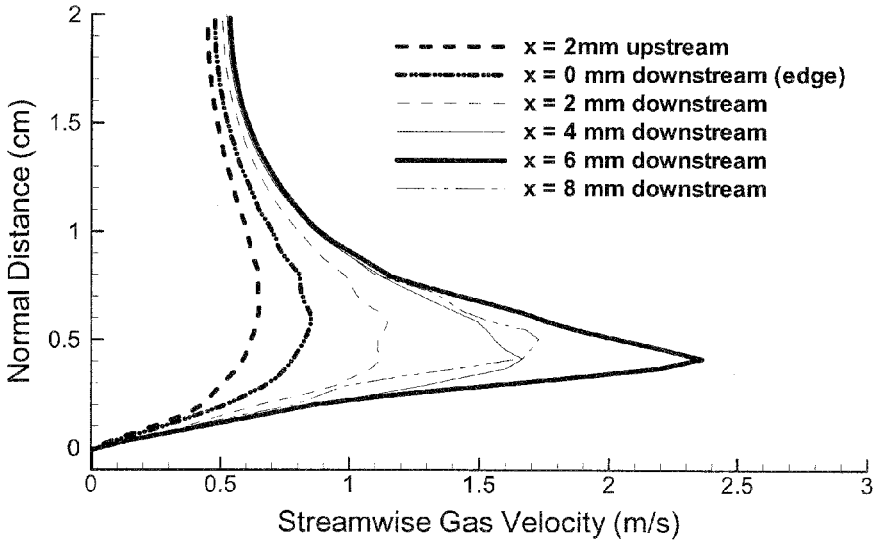

FIG. 3A shows EHD force prediction and FIG. 3B shows the induced gas velocity due to this force for an asymmetric arrangement in which a grounded electrode is embedded in Kapton insulator and displaced slightly downstream of an electrode exposed to a quiescent working gas. The exposed electrode can be powered by a 2 kV peak-to-peak voltage alternating at 5 kHz. FIG. 3A plots the streamwise component of the time average of volume specific body force in μN for quiescent flow. The line trace of the force vectors is showing a directional bifurcation just downstream of the exposed electrode. Due to fluid inertia, the bulk gas will only respond to this average force that will ensure its net forward motion. The momentum thus imparted to the gas will induce a velocity along the dielectric surface. Referring to FIG. 3A it can be seen that predicted time average of streamwise component of the force about the surface of the actuator shows the dominance of the streamwise forward (positive) force component. FIG. 3B plots the streamwise component of the computed gas velocity at six local vertical line plots downstream of the electrode edge and shows a wall jet like feature. The zero flow initial condition makes the computational problem more challenging.

FIGS. 4A-4B show details along the inner perimeter of a flow conduit. FIG. 4A shows an example of a periodic pattern for implementing straight pumping. FIG. 4B shows an example of a step pattern for swirl pumping. In a specific embodiment, each electrode pair along the length of the flow conduit can rotate with respect to the electrode pair before it, around the longitudinal axis of the flow conduit, as shown in FIG. 4B, so as to create a swirl flow pattern.

Specifics of the geometry of an embodiment example are given in the table below.

| w1 | w2 | d | g | h | b | P |
|---|---|---|---|---|---|---|
| <5 mm | <1 cm | <3 mm | ~w1 | <3 mm | <5 mm | 2pb |

where w1 is width of the powered electrode, w2 is the width of the grounded electrode, d is the distance between the powered electrode and the grounded electrode, g is the actuator gap, h is the distance the powered electrode and the grounded electrode are kept apart by an insulator layer, b is the bore diameter, and P is the inner perimeter of the flow passage. It should be noted that the values stated in the above table can be adjusted as needed.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

The invention claimed is:

1. A device, comprising:

a conduit having at least one surface; and at least one electrode pair positioned on the at least one surface of the conduit for pumping fluid through the conduit, wherein one electrode of an electrode pair of the at least one electrode pair is separated from the other electrode of the electrode pair by an interelectrode distance d in the direction of fluid flow, wherein when powered the at least one electrode pair creates a plasma that induces an electrohydrodynamic body force to the fluid in the conduit so as to pump the fluid through the conduit.

2. The device according to claim 1, wherein the at least one surface of the conduit comprises an insulator material, wherein electrodes of one or more of the at least one electrode pair are separated by the insulator material.

3. The device according to claim 1, wherein electrodes of one or more of the at least one electrode pairs pair are on the at least one surface of the conduit.

4. The device according to claim 1, wherein one or more of the at least one electrode pair is powered by direct current.

5. The device according to claim 1, wherein one or more of the at least one electrode pair is powered by alternating current.

6. The device according to claim 1, wherein the conduit has a circular cross-section and has an inner diameter of less than about 5 mm, wherein the width of a powered electrode is less than 5 mm, wherein the width of a grounded electrode is less than 1 cm, wherein the interelectrode distance separating the electrodes of the electrode pair along the fluid flow direction is less than 3 mm, wherein adjacent electrode pairs are separated by approximately the width of the powered electrode, and wherein a distance separating the powered electrode from the grounded electrode by an insulator material is less than 3 mm.

7. The device according to claim 1, wherein the at least one electrode pair is asymmetrically staggered in a step pattern for swirl pumping.

8. The device according to claim 1, wherein the device is a blood pump, wherein the device is adapted for pumping blood through the conduit.

9. The device according to claim 1, wherein the device comprises at least two plates, wherein the at least one surface comprises a surface on each of two of the at least two plates, wherein the conduit is between the two of the at least two plates.

10. The device according to claim 1, wherein the conduit has a cross-sectional shape selected from the following: circular, elliptical, square, rectangular, and hexagonal.

11. The device according to claim 1, wherein the device is a pump for a conducting fluid.

12. The device according to claim 1, wherein the device is a pump for a non-conducting fluid, wherein the device is adapted to pump the non-conducting fluid through the conduit.

13. The device according to claim 1, wherein the device is an air pump, wherein the device is adapted to pump air through the conduit.

14. The device according to claim 1, wherein the device is an air filter, wherein one or more of the at least one electrode pair extracts impurities from the air pumped through the conduit.

15. The device according to claim 1, wherein the device is adapted to apply a magnetic field to the conduit, wherein the magnetic field applies a magnetohydrodynamic effect to the fluid pumped through the conduit.

16. The device according to claim 1, wherein the at least one electrode pair acts as a dynamic barrier discharge electrode pair.

17. The device according to claim 2, wherein a powered electrode of each of the one or more of the at least one electrode pair is exposed at an inside of the conduit and a grounded electrode of each of the one or more of the at least one electrode pair is separated from the powered electrode by the insulator material.

18. The device according to claim 4, wherein the direct current is pulsed.

19. The device according to claim 4, wherein the at least one electrode pair is asymmetrically staggered in a periodic pattern for straight pumping.

20. The device according to claim 5, wherein the alternating current operates at a radio frequency.

21. The device according to claim 6, wherein electrodes of one or more of the at least one electrode pair are separated by the insulator material, wherein the powered electrode of each of the one or more of the at least one electrode pair is exposed at an inside of the conduit and the grounded electrode of each of the one or more of the at least one electrode pair is separated from the powered electrode by the insulator material.

22. The device according to claim 9, wherein the device comprises at least one additional conduit between at least two more of the at least two plates.

23. A method of pumping a fluid, comprising:

providing a conduit having at least one surface;

providing at least one electrode pair positioned on the at least one surface of the conduit for pumping fluid through the conduit, wherein one electrode of an electrode pair of the at least one electrode pair is separated from the other electrode of the electrode pair by an interelectrode distance d in the direction the fluid is pumped; and powering one or more of the at least one electrode pair, wherein powering the one or more of the at least one electrode pair creates a plasma that induces an electrohydrodynamic body force on the fluid in the conduit so as to pump the fluid in the conduit in a particular direction.

24. The method according to claim 23, wherein the fluid is a conducting fluid.

25. The method according to claim 23, wherein the fluid is blood.

* * * * *

UNITED STATES PATENT AND TRADEMARK OFFICE

CERTIFICATE OF CORRECTION

PATENT NO. : 8,348,626 B2
APPLICATION NO. : 12/669069
DATED : January 8, 2013
INVENTOR(S) : Subrata Roy It is certified that error appears in the above-identified patent and that said Letters Patent is hereby corrected as shown below:

In the Claims:

Column 6,
Line 4, "electrode pairs pair are" should read --electrode pair are--.

Signed and Sealed this
Sixth Day of August, 2013

Teresa Stanek Rea
*Acting Director of the United States Patent and Trademark Office*